US009112312B2

(12) United States Patent
Katayanagi

(10) Patent No.: US 9,112,312 B2
(45) Date of Patent: Aug. 18, 2015

(54) ELECTRICAL CONNECTOR IMPROVED IN ELECTROMAGNETIC SHIELDING EFFECT WHILE SUPPRESSING AN INCREASE IN EXTERNAL DIMENSIONS

(71) Applicant: Japan Aviation Electronics Industry, Limited, Tokyo (JP)

(72) Inventor: Masayuki Katayanagi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 136 days.

(21) Appl. No.: 14/042,773

(22) Filed: Oct. 1, 2013

(65) Prior Publication Data

US 2014/0322953 A1 Oct. 30, 2014

(30) Foreign Application Priority Data

Apr. 26, 2013 (JP) ..... 2013-093701

(51) Int. Cl.
*H01R 13/648* (2006.01)
*H01R 13/6582* (2011.01)

(52) U.S. Cl.
CPC ..... *H01R 13/6582* (2013.01)

(58) Field of Classification Search
CPC ..... H01R 13/658; H01R 13/65802; H01R 23/6873
USPC ..... 439/353
See application file for complete search history.

(56) References Cited

U.S. PATENT DOCUMENTS

| | | | | |
|---|---|---|---|---|
| 6,368,154 | B1 | 4/2002 | Hirata et al. | |
| 6,947,290 | B2 * | 9/2005 | Hirata | 361/741 |
| 7,887,370 | B2 * | 2/2011 | Chen et al. | 439/607.35 |
| 2009/0311907 | A1 | 12/2009 | Li | |
| 2010/0273360 | A1 | 10/2010 | Chen et al. | |

FOREIGN PATENT DOCUMENTS

| | | | |
|---|---|---|---|
| JP | 2010-257926 | A | 11/2010 |
| KR | 10-2001-0007060 | A | 1/2001 |
| KR | 10-2012-0069530 | A | 6/2012 |

OTHER PUBLICATIONS

Korean Office Action in 9-5-2014-071080423, dated Oct. 20, 2014, with English translation.

* cited by examiner

*Primary Examiner* — Vanessa Girardi
(74) *Attorney, Agent, or Firm* — Collard & Roe, P.C.

(57) ABSTRACT

An electrical connector comprises a metal shell defining an opening for inserting a connection counterpart therethrough. The electrical connector has a cantilever spring extending from an end, on the opening side, of the metal shell and folded back outward. The cantilever spring has a free end portion passing through a hole formed in the metal shell, and extending to the inside of the metal shell. Preferably, the metal shell has a top surface and a bottom surface facing each other and the cantilever spring is provided to at least one of the top surface and the bottom surface.

9 Claims, 6 Drawing Sheets

ELECTRICAL CONNECTOR IMPROVED IN ELECTROMAGNETIC SHIELDING EFFECT WHILE SUPPRESSING AN INCREASE IN EXTERNAL DIMENSIONS

This application is based upon and claims the benefit of priority from Japanese Patent Application No. 2013-093701, filed Apr. 26, 2013, the disclosure of which is incorporated herein in its entirety by reference.

BACKGROUND OF THE INVENTION

1. Field of the Invention

This invention relates to an electrical connector and, more specifically, relates to an electrical connector including a metal shell defining an opening for inserting a connection counterpart therethrough.

2. Description of Related Art

As one example of this type of electrical connector, a USB connector is known. High-speed signal transmission is required also for the USB connector. Herein, referring to FIG. 1, a USB connector disclosed in JP-A-2010-257926 (Patent Document 1) will be briefly explained.

Referring to FIG. 1, a receptacle 1 as a USB connector comprises a metal shell 2. The metal shell 2 has a hollow rectangular prism portion 3 into which a plug (not illustrated) as a connection counterpart or a mating USB connector is adapted to be inserted. The hollow rectangular prism portion 3 is formed with EMI springs 4 by means of cutouts at three portions in total, i.e. one in each of an upper surface and left and right side surfaces. These EMI springs 4 are brought into contact with a metal shell of the plug inserted into the hollow rectangular prism portion 3 to ground the metal shell of the plug. Accordingly, the electromagnetic shielding effect can be expected to a degree. Symbol 5 denotes spring pieces adapted to be fitted to locking holes of the inserted plug, thereby locking the connected state of the connectors.

SUMMARY OF THE INVENTION

In the receptacle 1 shown in FIG. 1, however, the EMI springs 4 are formed only at the three portions and therefore the electromagnetic shielding effect is insufficient for high-speed signal transmission.

In view of this, it has been studied to increase the number of EMI springs in this type of electrical connector. Even when the number of EMI springs is increased, an electrical connector is required to have substantially the same external dimensions as those of this type of conventional receptacle and to be compatible with this type of conventional plug.

It is therefore an exemplary object of this invention to provide a receptacle-type electrical connector which is improved in electromagnetic shielding effect while it has substantially the same external dimensions as those of a conventional receptacle and is compatible with a conventional plug.

Other objects of this invention will become clear as the description proceeds.

According to an aspect of the invention, there is provided an electrical connector which comprises a metal shell defining an opening for inserting a connection counterpart therethrough and a cantilever spring extending from an end, on the opening side, of the metal shell and folded back outward, wherein the cantilever spring has a free end portion passing through a hole formed in the metal shell, and extending to the inside of the metal shell.

DESCRIPTION OF THE EXEMPLARY EMBODIMENTS

Figure 1:
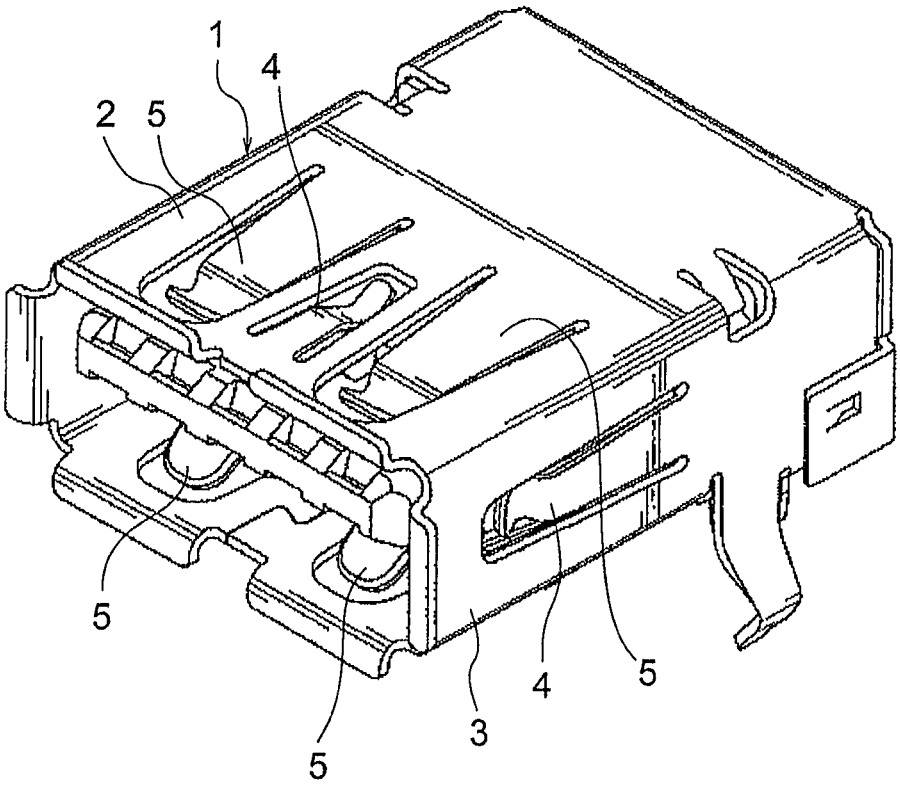
FIG. 1 RELATED ART
FIG. 1 is a perspective view, as seen from one side, of a receptacle disclosed in Patent Document 1 (JP-A-2010-257926)

Referring to the drawings, an electrical connector according to an exemplary embodiment of this invention will be described.

Figure 2:
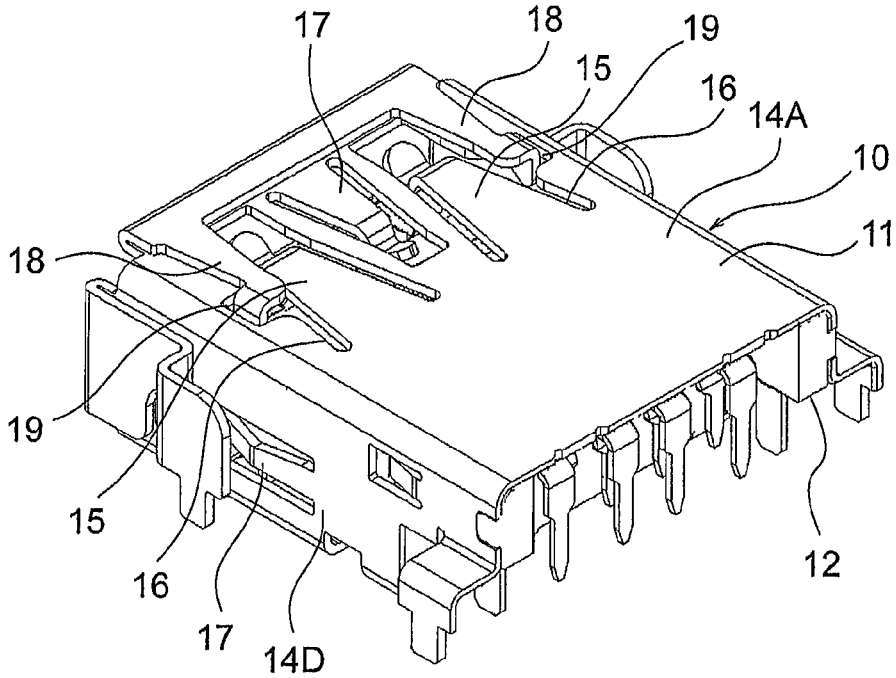
FIG. 2 is a perspective view, as seen from one side, of an electrical connector according to an exemplary embodiment of this invention.
Figure 3:
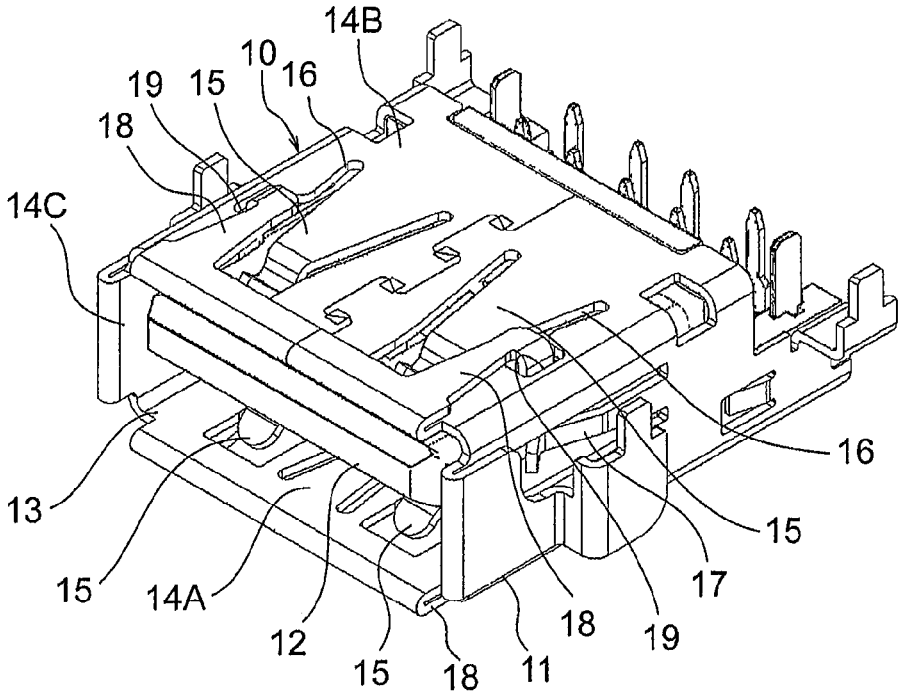
FIG. 3 is a perspective view, as seen from the other side, of the electrical connector of FIG. 2.
Figure 4:
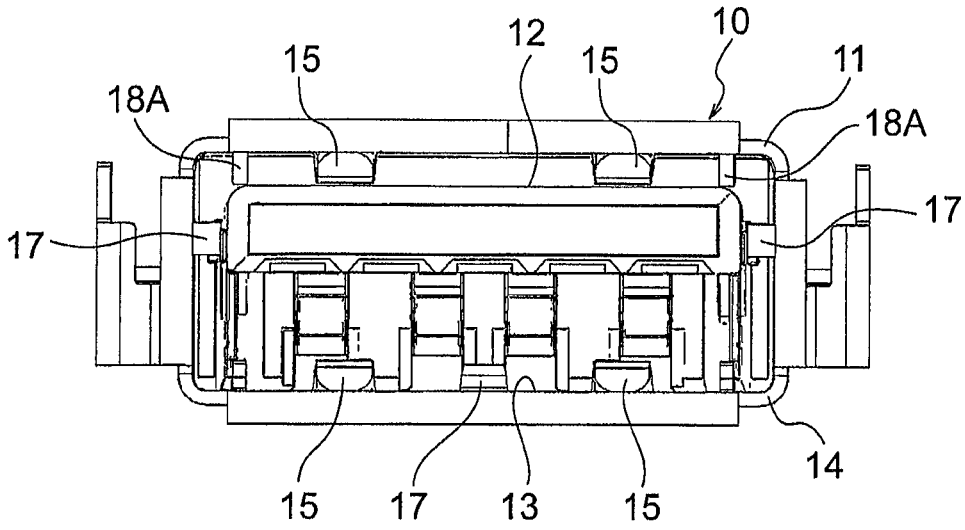
FIG. 4 is a front view of the electrical connector of FIGS. 2 and 3.

FIGS. 2 to 4 show a USB connector receptacle (hereinafter referred to simply as a "receptacle") 10 as an electrical connector. The receptacle 10 comprises a metal shell 11 and an insulator 12 received in the metal shell 11. The insulator 12 holds conductive contacts (not illustrated).

Figure 5:
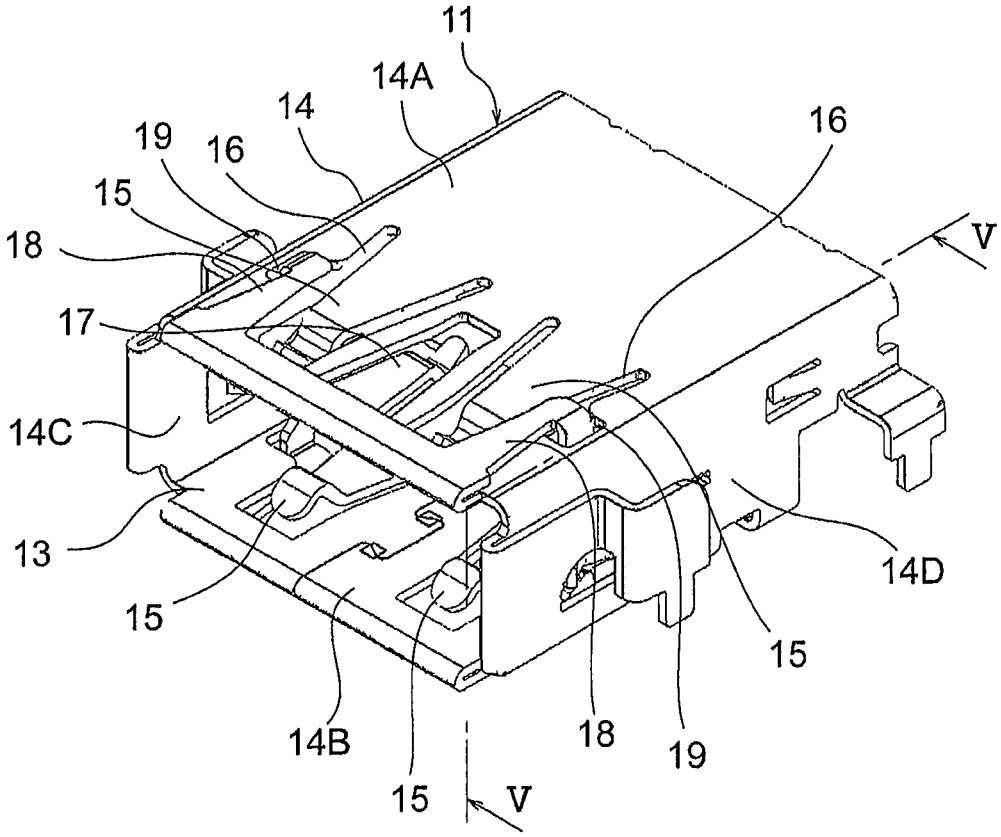
FIG. 5 is a perspective view of a metal shell included in the electrical connector of FIGS. 2 to 4.
Figure 6:
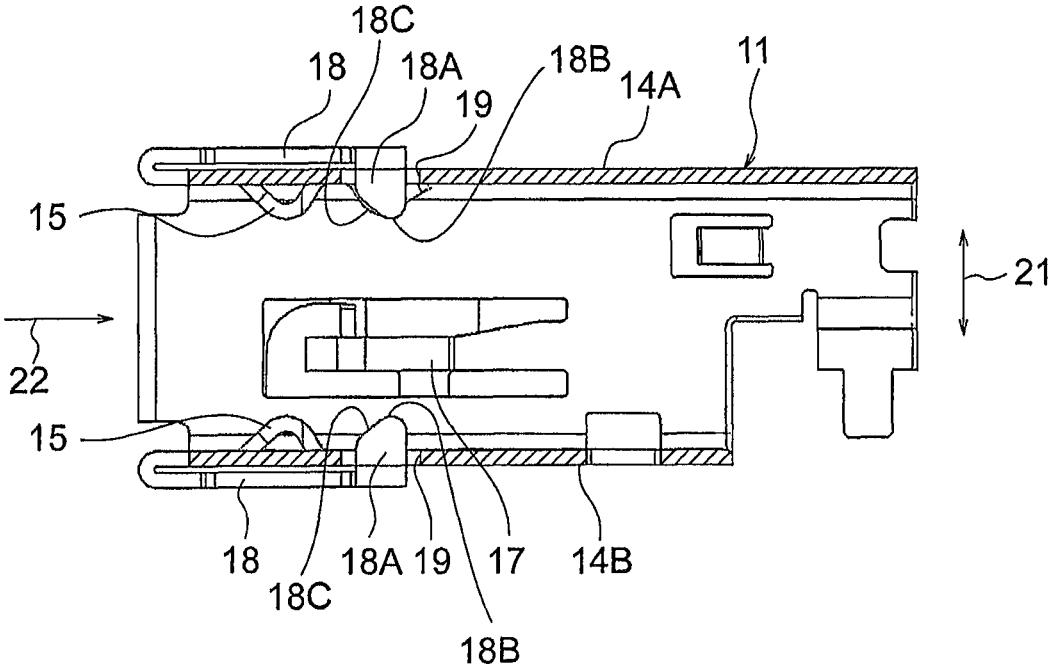
FIG. 6 is a cross-sectional view taken along line VI-VI of FIG. 5.

FIGS. 5 and 6 show the metal shell 11. The metal shell 11 has a hollow prism portion 14 with a rectangular cross section which defines an opening 13 for inserting a connection counterpart therethrough. The hollow prism portion 14 is formed with four locking springs 15 in total, i.e. two in each of a top surface 14A and a bottom surface 14B facing each other with a space therebetween, by providing cutouts 16 in the top and bottom surfaces 14A and 14B. These locking springs 15 are adapted to be fitted to locking holes 42 provided in a metal shell 41 of a conventional USB connector plug (hereinafter referred to simply as a "plug") 40 as a connection counterpart shown in FIG. 8, thereby locking the connected state of the receptacle 10 and the plug 40. In this manner, the metal shell 11 forms a friction locking mechanism for locking the plug 40 in the inserted state by means of the cutouts.

The hollow prism portion 14 is further formed with EMI springs 17 by means of cutouts at three portions in total, i.e. one in each of the top surface 14A and left and right side surfaces 14C and 14D adjacent to the top surface 14A. These EMI springs 17 are brought into contact with the metal shell 41 of the plug 40 inserted into the hollow prism portion 14 to ground the metal shell 41 of the plug 40.

The metal shell 11 is further provided with four cantilever springs 18 in total which respectively extend from ends, on the opening 13 side, of the top and bottom surfaces 14A and 14B of the hollow prism portion 14 and are smoothly bent outward and folded back along the top and bottom surfaces 14A and 14B. In the following description, these springs 18 will be referred to as "additional springs".

The two additional springs 18 extending from the top surface 14A are formed wide and integral with each other near the opening 13 (see FIG. 2). The two additional springs 18 extending from the bottom surface 14B are formed wide and adjacent to or in contact with each other near the opening 13 (see FIG. 3). As a result, the opening 13 is reinforced so that the rigidity of the metal shell 11 is enhanced.

The top and bottom surfaces 14A and 14B of the hollow prism portion 14 are each formed with holes 19. The holes 19 are respectively located near the left and right side surfaces 14C and 14D and are respectively continuous with the cutouts 16. The additional springs 18 each have a free end portion 18A which is perpendicularly bent and extends to the inside of the hollow prism portion 14 through the hole 19. Therefore, the free end portions 18A of the additional springs 18 are also respectively located near the left and right side surfaces 14C and 14D. Each hole 19 is continuous with the cutout 16 in this embodiment, but may be formed as an independent hole separately from the cutout 16.

Figure 8:
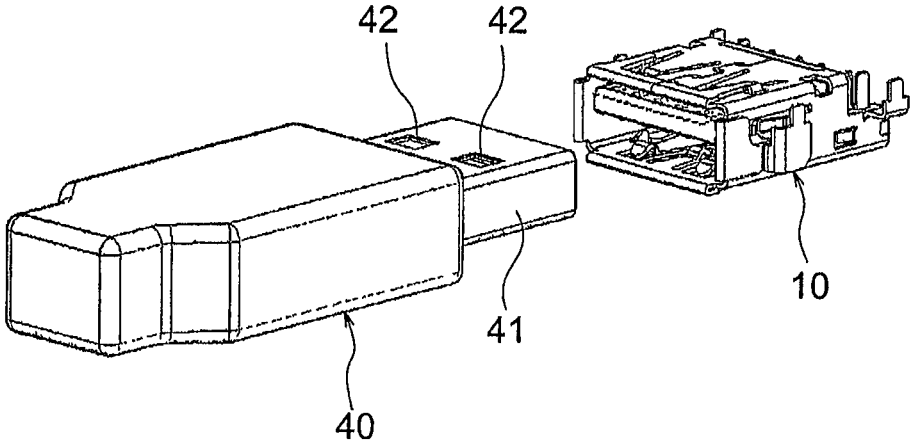
FIG. 8 is a perspective view showing the electrical connector of FIGS. 2 to 4 and an electrical connector connectable thereto.

The receptacle 10 configured as described above can be fitted and connected to the conventional plug 40 shown in FIG. 8. That is, the receptacle 10 is compatible with a conventional plug. Since the additional springs 18 of the receptacle 10 are smoothly bent and folded back, the additional springs 18 serve to guide the plug 40 at the time of insertion so that the insertion is facilitated. When the plug 40 is inserted into the receptacle 10, the free end portions 18A of the four additional springs 18 as well as the three EMI springs 17 of the receptacle 10 are brought into contact with the metal shell 41 of the plug 40. In this case, the additional springs 18 are surely brought into contact with the metal shell 41 like the EMI springs 17, thus achieving the same function as the EMI springs 17. Therefore, this is equivalent to increasing the number of EMI springs and thus makes it possible to improve the electromagnetic shielding effect.

Figure 7:
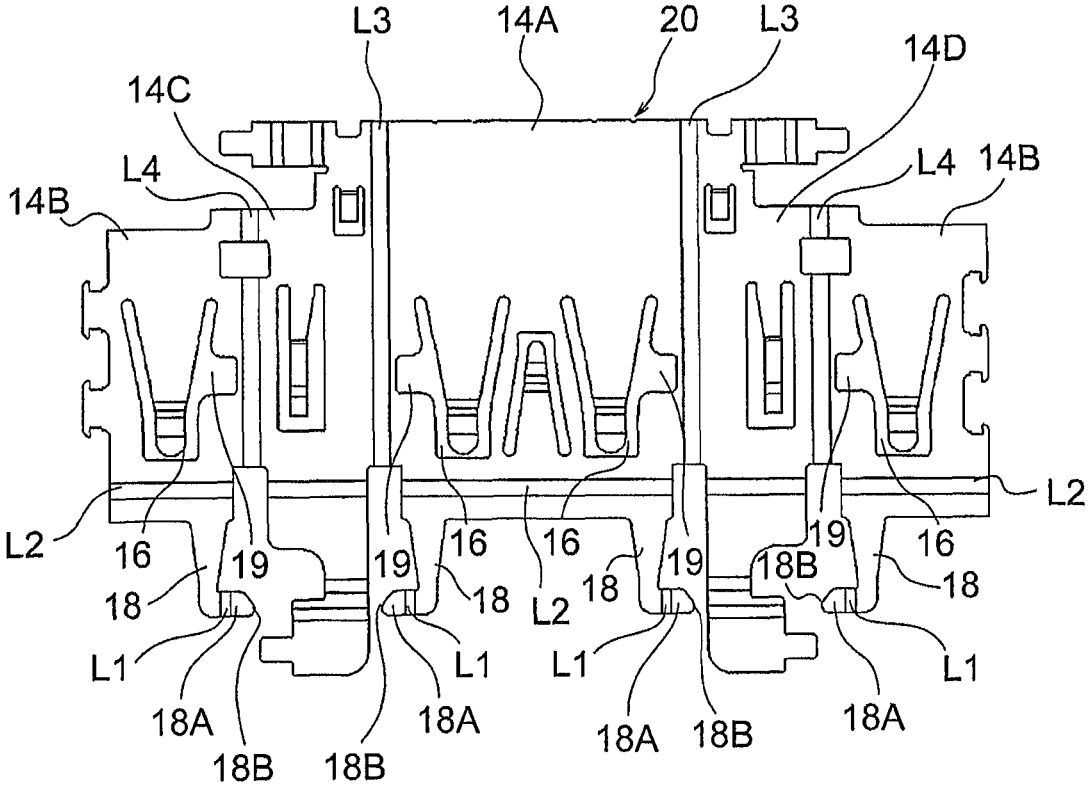
FIG. 7 shows a blank of the metal shell of FIG. 5.

Referring now to FIG. 7, the manufacture of the metal shell 11 will be described.

First, press working is applied to a metal plate, thereby obtaining a blank 20 having a shape shown in FIG. 7. Then, bending is suitably applied to the blank 20, thereby manufacturing the metal shell 11 shown in FIGS. 5 and 6. In FIG. 7, portions each between two parallel lines serve as bending portions adapted to be bent for manufacturing the metal shell 11.

Herein, in particular, the formation of the additional springs 18 will be described in detail. The free end portion 18A of each additional spring 18 has a cut surface 18B as it was sheared by the press working. This free end portion 18A is bent along a bending portion L1 perpendicularly to the drawing sheet toward the front surface side of the drawing sheet. Further, the additional spring 18 is bent along a bending portion L2 toward the front surface side of the drawing sheet and then folded back. As a result, the free end portion 18A passes through the hole 19 and extends to the back surface side of the drawing sheet.

Predetermined bending is applied to other portions and then the left and right side surfaces 14C and 14D and halves of the bottom surface 14B are respectively bent along bending portions L3 and L4. In this manner, the metal shell 11 shown in FIGS. 5 and 6 is obtained.

As a result, even in the completed metal shell 11, the free end portion 18A of each additional spring 18 has the shearing cut surface 18B formed by the press working. Consequently, the shearing cut surfaces 18B of the free end portions 18A of the additional springs 18 are brought into contact with the metal shell 41 of the plug 40 so that fine projections of the shearing cut surfaces 18B bite into the metal shell 41. As a result, the contact reliability is improved.

As clearly shown in FIG. 6, the free end portion 18A of each additional spring 18 is a plate-like portion parallel to a plane spreading in a first direction 21 crossing (perpendicular to) the top and bottom surfaces 14A and 14B and a second direction 22 in which the plug 40 is inserted. Further, the shearing cut surface 18B has a guide portion 18C which is inclined to the second direction 22 so as to guide the insertion of the plug 40. Therefore, although the fine projections of the shearing cut surfaces 18B bite into the metal shell 41 when inserting the plug 40 into the receptacle 10, the insertion of the plug 40 can be easily carried out.

Since the metal shell 11 can be manufactured by bending the blank 20 obtained by the press working, it is excellent in manufacturability and dimensional accuracy.

Further, since the additional springs 18 are folded back from the ends, defining the opening 13, of the hollow prism portion 14, they can be formed without space restriction.

Figure 9:
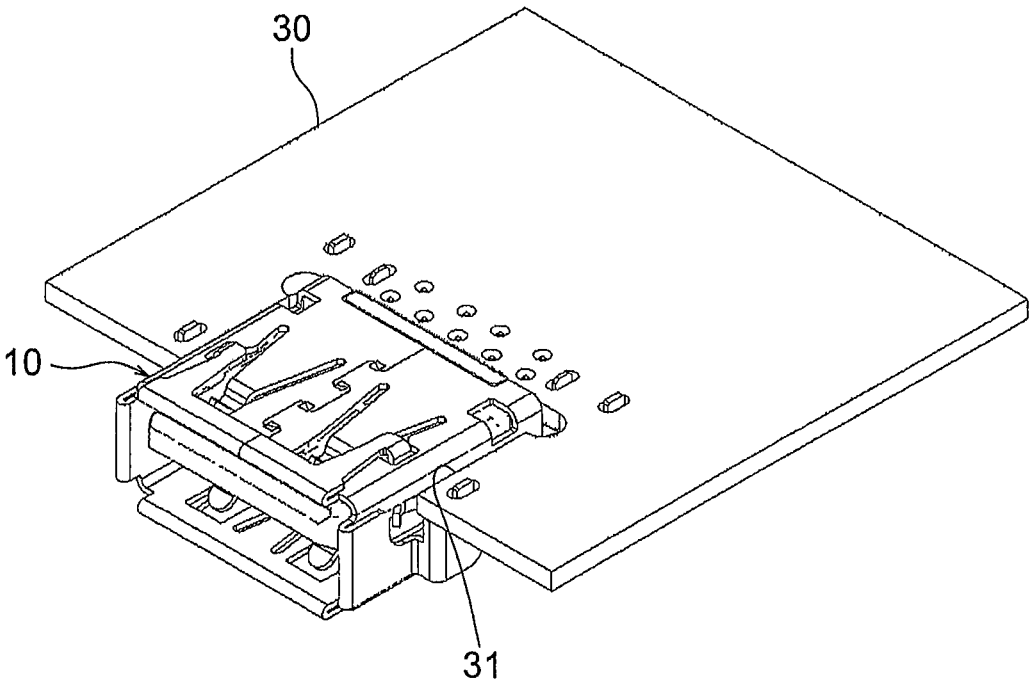
FIG. 9 is a perspective view showing a state where the electrical connector of FIGS. 2 to 4 is attached to a board.

The external dimensions of the receptacle 10 are substantially the same as those of a conventional receptacle and, in particular, the width thereof has no difference from that of the conventional one. Consequently, as shown in FIG. 9, the receptacle 10 can be subjected to so-called edge mounting to a recessed portion 31 of an existing predetermined shape formed at an edge portion of a board 30. This means that the conventional receptacle edge-mounted to the board 30 can be easily replaced with the receptacle 10.

Alternatively, the receptacle 10 can also be subjected to so-called on-board mounting on an upper surface of a board.

Figure 10:
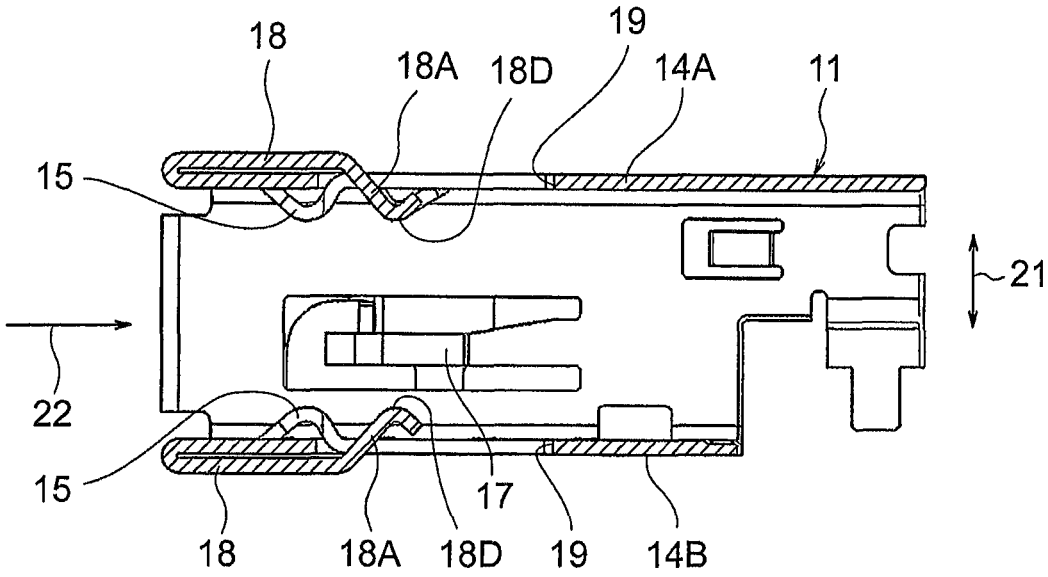
FIG. 10 is a cross-sectional view, similar to FIG. 6, showing a modification of the metal shell of FIGS. 5 and 6.
Figure 11:
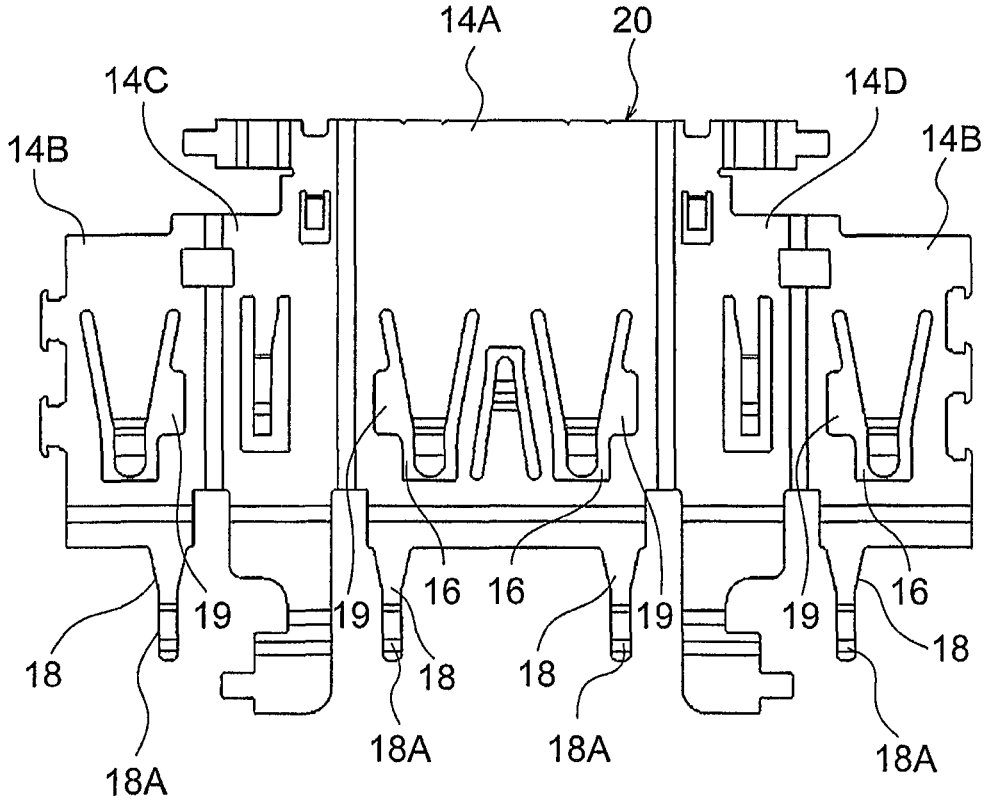
FIG. 11 is a developed view of the metal shell of FIG. 10.

As described above, the free end portion 18A of each additional spring 18 preferably has the shearing cut surface 18B in terms of the contact reliability. However, in terms of preventing abrasion of the metal shell 41 of the plug 40, it may be configured such that, as shown in FIGS. 10 and 11, a free end portion 18A of each additional spring 18 is bent to form a smooth curved surface 18D and that the metal shell 41 of the plug 40 is brought into contact with these smooth curved surfaces 18D.

While this invention has been described with reference to the exemplary embodiments thereof, the invention is not limited thereto. For example, the additional springs 18 may extend from at least one of the top and bottom surfaces 14A and 14B and the number and shape of the additional springs 18 are not limited to those in the above-mentioned embodiments.

A part or the whole of this invention can also be described as the following supplementary notes but is not limited thereto.

(Supplementary note 1) An electrical connector 10 comprising:

a metal shell 2 defining an opening 13 for inserting a connection counterpart therethrough; and a cantilever spring 18 extending from an end, on the opening side, of the metal shell and folded back outward, wherein the cantilever spring has a free end portion 18A passing through a hole 19 formed in the metal shell, and extending to the inside of the metal shell.

According to this electrical connector, the electromagnetic shielding effect can be improved while it has substantially the same external dimensions as those of a conventional receptacle and is compatible with a conventional plug. Therefore, it is possible to achieve both miniaturization and high-speed signal transmission of the electrical connector.

(Supplementary note 2) The electrical connector according to supplementary note 1, wherein the metal shell forms a friction locking mechanism for locking the connection counterpart in an inserted state by means of a cutout 16 and the hole is continuous with the cutout.

(Supplementary note 3) The electrical connector according to supplementary note 1 or 2, wherein the metal shell has a top surface 14A and a bottom surface 14B facing each other and the cantilever spring extends from at least one of the top surface and the bottom surface.

(Supplementary note 4) The electrical connector according to supplementary note 3, wherein the metal shell has a side surface 14C or 14D adjacent to the top surface and the bottom surface, and the cantilever spring and the hole are located near the side surface.

(Supplementary note 5) The electrical connector according to any one of supplementary notes 1 to 4, wherein the free end portion of the cantilever spring has a shearing cut surface 18B formed by press working and the shearing cut surface is adapted to be brought into contact with the connection counterpart.

(Supplementary note 6) The electrical connector according to supplementary note 5, wherein the free end portion of the cantilever spring is a plate-like portion parallel to a direction 22 in which the connection counterpart is inserted.

(Supplementary note 7) The electrical connector according to supplementary note 5 or 6, wherein the shearing cut surface has a guide portion 18C which is inclined so as to guide insertion of the connection counterpart.

(Supplementary note 8) The electrical connector according to any one of supplementary note s 1 to 4, wherein the free end portion of the cantilever spring has a curved surface 18D formed by bending and the curved surface is adapted to be brought into contact with the connection counterpart.

(Supplementary note 9) The electrical connector according to any one of supplementary notes 1 to 8, wherein the cantilever spring is bent and folded back from the end of the metal shell.

While the invention has been particularly shown and described with reference to the exemplary embodiments thereof, the invention is not limited to these embodiments. It will be understood by those of ordinary skill in the art that various changes in form and details may be made therein without departing from the sprit and scope of this invention as defined by the claims.

What is claimed is:

1. An electrical connector comprising:

a metal shell defining an opening for inserting a connection counterpart therethrough; and a cantilever spring extending from an end, on the opening side, of the metal shell and folded back outward, wherein the cantilever spring has a free end portion passing through a hole formed in the metal shell, and extending to the inside of the metal shell.

2. The electrical connector according to claim 1, wherein the metal shell forms a friction locking mechanism for locking the connection counterpart in an inserted state by means of a cutout and the hole is continuous with the cutout.

3. The electrical connector according to claim 1, wherein the metal shell has a top surface and a bottom surface facing each other and the cantilever spring extends from at least one of the top surface and the bottom surface.

4. The electrical connector according to claim 3, wherein the metal shell has a side surface adjacent to the top surface and the bottom surface, and the cantilever spring and the hole are located near the side surface.

5. The electrical connector according to claim 1, wherein the free end portion of the cantilever spring has a shearing cut surface formed by press working and the shearing cut surface is adapted to be brought into contact with the connection counterpart.

6. The electrical connector according to claim 5, wherein the free end portion of the cantilever spring is a plate-like portion parallel to a direction in which the connection counterpart is inserted.

7. The electrical connector according to claim 5, wherein the shearing cut surface has a guide portion which is inclined so as to guide insertion of the connection counterpart.

8. The electrical connector according to claim 1, wherein the free end portion of the cantilever spring has a curved surface formed by bending and the curved surface is adapted to be brought into contact with the connection counterpart.

9. The electrical connector according to claim 1, wherein the cantilever spring is bent and folded back from the end of the metal shell.

* * * * *